US006604703B2

(12) United States Patent
Beisswanger et al.

(10) Patent No.: US 6,604,703 B2
(45) Date of Patent: Aug. 12, 2003

(54) METHOD AND WINDER FOR CONTINUOUS WINDING OF A MATERIAL WEB

(75) Inventors: Rudolf Beisswanger, Steinheim (DE); Zygmunt Madrzak, Heidenheim (DE); Matthias Wohlfahrt, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/880,490

(22) Filed: Jun. 13, 2001

(65) Prior Publication Data

US 2001/0052560 A1 Dec. 20, 2001

(30) Foreign Application Priority Data

Jun. 20, 2000 (DE) ..... 100 30 199

(51) Int. Cl.[7] ..... B65H 18/26

(52) U.S. Cl. ..... 242/541.4; 242/541.5; 242/541.6; 242/541.7; 242/542.3

(58) Field of Search ..... 242/541.4, 541.5, 242/541.6, 547, 542.3

(56) References Cited

U.S. PATENT DOCUMENTS

| | | | | |
|---|---|---|---|---|
| 4,934,619 A | * | 6/1990 | Snygg | 242/542.3 X |
| 5,026,005 A | | 6/1991 | Ehrola | 242/65 |
| 5,106,029 A | * | 4/1992 | Ehrola | 242/541.7 |
| 5,308,008 A | * | 5/1994 | Ruegg | 242/541.7 |
| 5,931,406 A | * | 8/1999 | Siebert | 242/541.4 |
| 5,967,449 A | * | 10/1999 | Thomas et al. | 242/541.6 X |
| 6,129,305 A | | 10/2000 | Möet al. | 242/541 |
| 6,250,580 B1 | * | 6/2001 | Madrzak et al. | 242/541.6 X |
| 6,402,082 B1 | * | 6/2002 | Madrzak et al. | 242/541.4 |

FOREIGN PATENT DOCUMENTS

| | | |
|---|---|---|
| DE | 25 55 677 A1 | 6/1977 |
| DE | 198 07 897 A1 | 8/1999 |
| EP | 0 369 977 B1 | 6/1994 |
| EP | 0 483 092 B1 | 1/1998 |
| WO | WO 98/52858 | 11/1998 |

* cited by examiner

*Primary Examiner*—Kathy Matecki
*Assistant Examiner*—Minh-Chau Pham
(74) *Attorney, Agent, or Firm*—Taylor & Aust, P.C.

(57) ABSTRACT

A method is provided using a winder to afford precise adjustment, preferably control of the progression of line force between the reel drum and the wound roll despite unevenness in the surface contour of the wound roll, and ensures that no air entrapment occurs between the individual layers in the wound roll. Further, the "wound in" web tension is maintained during the entire winding process.

20 Claims, 2 Drawing Sheets

METHOD AND WINDER FOR CONTINUOUS WINDING OF A MATERIAL WEB

BACKGROUND OF THE INVENTION

1. Field of the Invention

The present invention relates to a winder and a method for continuous winding of a material web, specifically a paper or cardboard web.

2. Description of the Related Art

Methods and winders such as disclosed in European patent publication EP 0 483 092 B1 or document PCT-WO 98/52858 A1 (PR10706 WO) are used in machinery for the production or converting of material webs, for example paper or cardboard webs.

Today's modern winding concepts employ contact pressure devices including either a hard cylindrical reel drum or a reel drum displaying negligible deformation characteristics. When utilizing these contact pressure devices a precise progression of the line force between reel drum and winding roll cannot always be ensured due to unevenness of the progression of the line force between carrier roll and winding roll, particularly in light of the desire that no trapping of air occur between the individual layers of the winding roll. In addition, considerable problems occur in the intended maintenance of the "wound in" web tension, specifically in maintaining the desired winding quality in the outer area of the wound roll. The problems arising in this context increase with increasing winder speed (1,500 to 2,500 m/min.) and with an increasing diameter of wound rolls (2.5 to 4.5 m).

A winder is disclosed in European patent documentation EP 0 369 977 (U.S. Pat. No. 5,026,005), whose rigidly mounted reel drum includes at least one winding cylinder which is equipped with at least one device for adjustment of the deflection of the cylinder shell, whereby at least one device is mounted inside the winding cylinder's shell. The presence of this at least one device creates the feasibility of controlling the distribution of the linear load in the winding nip during the winding process. The control possibilities however, are very limited, due to constructive factors. Such a device cannot ensure that no air entrapment occurs between the individual layers in the wound roll, nor can it ensure that the "wound in" web tension is maintained, in order to obtain the desired winding quality in the outer area of the wound roll.

A winder is also disclosed in the aforementioned document PCT WO 98/52858 A1 (PR10706 WO), which includes a movable reel drum. This movable reel drum is relatively light when compared to the weight of the increasingly larger wound roll, allowing rapid "stabilizing" of long-wave diameter variations in the wound roll. Short-wave diameter variations however, cannot be satisfactorily "stabilized".

What is needed in the art is a method and a winder which will provide a precise adjustment and control of the progression of line force between the reel drum and the wound roll despite unevenness in the surface contour of the wound roll, ensuring that no air entrapment occurs between the individual layers in the wound roll.

SUMMARY OF THE INVENTION

The present invention provides a method and winder that controls and adjusts the line force progression in the winding nip across the reel drum in individual zones. Long-wave diameter variations in the wound roll which influence the progression of the line force in the winding nip are compensated by relocation of the reel drum. In contrast, short-wave diameter variations in the wound roll, which influence the progression of line force in the winding nip, are compensated for by at least one support element of the reel drum which is constructed as a deflection compensation roller. The relocation of the reel drum and support element(s) provides the opportunity to control long-wave and short-wave diameter variations in the wound roll to avoid air entrapment between the individual layers of the wound roll and to maintain the "wound in" tension during the entire winding process.

In one embodiment of the invention a winder includes a reel drum that is moveable by means of a contact pressure device. The pope roll is a deflection compensation roll whose roll shell is supported on a stationary cross shaft by means of a row of side by side support elements. This allows the progression of the line force in the winding nip to be adjustable through the relocation of the reel drum and/or at least one support element.

The controllability and the winder's high winding quality is established, in one embodiment of the present invention, with support elements which are effective in the direction of the winding nip, and whose position is changeable.

During the various winding phases (initial winding phase, main winding phase, end winding phase) one embodiment of the present invention includes a cross shaft that can be pivoted so that the effective direction of the support elements track with movements of the winding nip. This embodiment verifies, adjusts and controls the critical winding phases throughout the winding process.

The support elements may be adjustable and controllable in their entirety, in sections, in groups and/or individually. The sensitivity of the winder is based on the sophistication of the adjustment devices and controllers. In one embodiment of the present invention the two edge areas of the reel drum are equipped with a larger number of support elements having smaller support widths. The support elements can be arranged in sections which are independent from each other or in various inter-independent groups, and may be configured in mirror image or overlapping zones. Generally, any combination of support elements in any desired number may be utilized.

Based on design, cost and operational aspects, the adjustment and control of the support elements occurs by means of a hydraulic system with an associated control unit. Such hydraulic systems have proven themselves suitable in other applications in a paper or cardboard machine. Hydraulic fluid may also be used as a lubricant for the gliding surfaces of the support elements. The control unit may utilize piezo quartz sensors integrated into the gliding surfaces of the support elements.

In yet another embodiment of the invention support elements have a supporting width of 25 to 500 mm, preferably of 50 to 250 mm; and they have a support stroke of 150 to 400 mm, preferably of 200 to 300 mm. The cross shaft will have a length of 500 to 800 mm, preferably 600 to 750 mm. The reel drum will have an inside diameter of 1,000 to 1,250 mm, preferably 1,100 to 1,200 mm and it will have an outer diameter of 1,300 to 1,500 mm, preferably 1,350 to 1,450 mm. These dimensional ranges afford the possibility under the aforementioned aspects, to operate an optimally functioning winder with good runability and at low cost.

It is understood that the aforementioned characteristics of the invention which will also be described further in the following, may be used not only in the cited combination, but also in other combinations or standing alone, without leaving the scope of the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
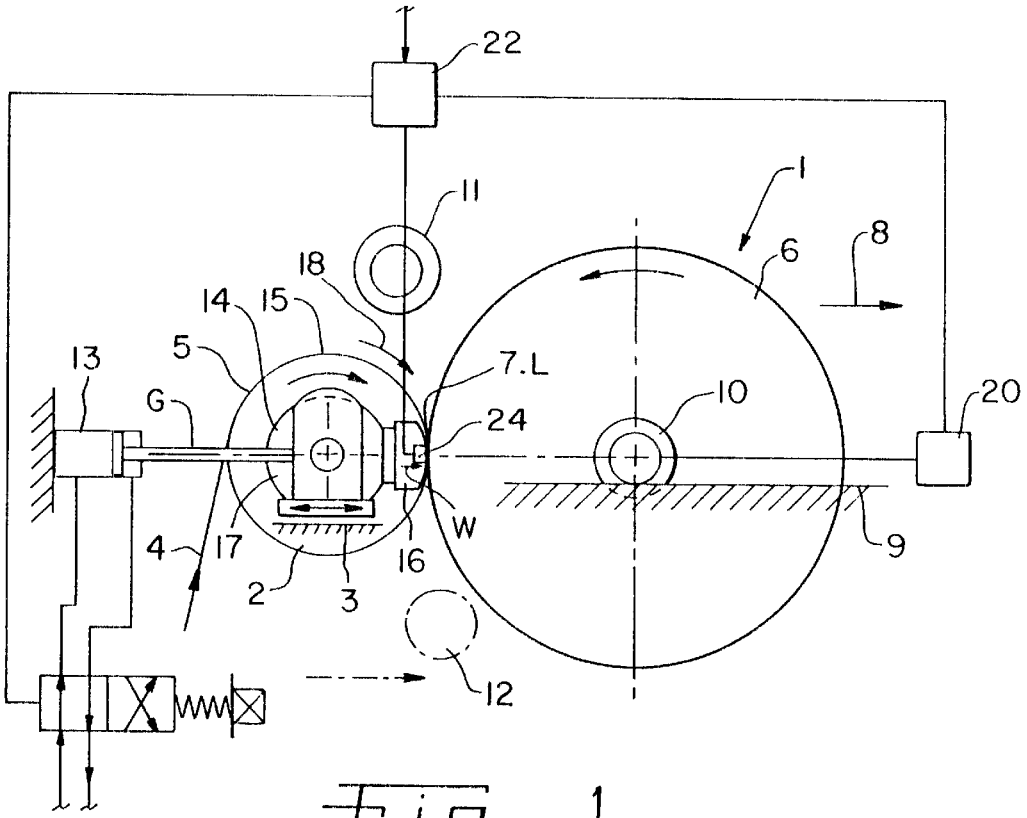
FIG. 1 is a schematic side view of a winder, including a reel drum during the main winding phase.

Referring now to the drawings, and more particularly to FIG. 1, there is shown winder 1 including reel drum 2, also referred to as a contact drum or support roll which is movable along imaginary broken horizontal line G, by means of pressure device 13, for example an illustrated piston unit or spindle drive (schematically shown as double arrow 3) which operates both bearing journals of pope roll 2, and which may be a center drive. The various mounting and movement methods for reel drum 2 are specifically disclosed in the applicant's German Disclosure Publication DE 198 07 897 A1 (PR10678 DE); its content is hereby incorporated by reference. Material web 4 is fed from either a calender which is not illustrated here or from a dryer section which is also not illustrated here, of a paper or cardboard machine. It then wraps around a spreader roll, which is not illustrated, and travels to shell surface 5 of reel drum 2, wraps around shell surface 5 of reel drum 2 at a certain angle (wrap-around area) until it is removed by the forming wound roll 6. The removal of material web 4 from reel drum 2, and the transfer to the forming wound roll 6 occurs in winding nip 7 which forms during the main winding phase between reel drum 2 and wound roll 6. Wound roll 6 is guided by means of a transport device which is not illustrated here, in the direction indicated by arrow 8. The transport device may for example be a spindle drive comprising a threaded spindle which may be driven be an electric motor. The transport device serves to hold and guide wound roll's 6 reel spool 10 which rests on rails 9 (slide way). During the main winding phase illustrated in FIG. 1, empty reel spool ("empty reel") 11 is held by a holding device, not illustrated here, at a certain distance from reel drum 2 ("stand-by position").

Reel drum 2 is relocated by pressure loading device 13, which also controls line force L in winding nip 7 by means of a control unit which is not illustrated in detail. Reel drum 2 is pressed against the circumference of wound roll 6 with a defined force, resulting in the desired winding hardness of wound roll 6, and a uniform winding hardness progression may be controlled. Due to the movement of reel drum 2 by pressure loading device 13, long-wave variations in line force L can be compensated for or avoided, so that a desired winding hardness may be continuously and optimally achieved. This also permits line force L to be held at a constant value when a comprehensive fault of extended duration (seconds to minutes range) occurs in the winding process. The control unit may utilize piezo quartz sensors which may be integrated into the gliding surfaces of support elements 16.

A long-wave diameter variation is a variation in the diameter of wound roll 6 along the circumference of wound roll 6 that extends across substantially the entire face of wound roll 6 In contrast a short-wave diameter variation is a variation in the diameter of wound roll 6 along the circumference of wound roll 6 that only extends a short distance across the face of wound roll 6. A long-wave diameter variation is detected by long-wave diameter variation detector 20 and the variation information is passed to controller 22 for the controllable extension/retraction of contact pressure device 13, which correspondingly moves cross shaft 17, thereby reducing long-wave diameter variations. In a similar manner short-wave diameter variation is detected by short wave diameter variation detectors 24 and the variation information is passed to controller 22 for the controllable extension/retraction of support elements 16, which selectively apply pressure to a zone of reel drum 2, thereby reducing short-wave diameter variations.

Below wound roll 6 air loaded rider roll 12 is illustrated in a dot-dash configuration. During the main winding phase it has no active relationship with wound roll 6 and remains in a stand-by position. Air loaded rider roll 12 may be moved with generally known mechanisms in linear, preferably in horizontal and/or vertical direction, as well as essentially along a contour of a segment of circle.

Reel drum 2 is moveable by means of pressure loading device 13 and may be embodied as a deflection compensation roll 14 whose roll shell 15 is supported on stationary cross shaft 17 by means of a row of side by side support elements 16. The progression of line force L of winding nip 17 is adjustable and preferably controllable through relocation of reel drum 2 and/or at least one of support elements 16. Based on this embodiment of reel drum 2 it is feasible to achieve a precise adjustment and preferably control of the progression of line force L between reel drum 2 and wound roll 6, despite unevenness in the surface contour of wound roll 6 (short-wave variations), and to avoid air entrapments between the individual layers of wound roll 6. Support elements 16 are effective, preferably in the direction of winding nip 7, whose position is changeable and cross shaft 17 can be pivoted so that effective direction W of support elements 16 follow the movement of winding nip 7, as indicated by arrow 18. Support elements 16 are adjustable and preferably controllable, either in their entirety, in sections, in groups and/or individually. The adjustment, preferably control, of support elements 16 is accomplished through a hydraulic system with an associated control unit, as known from German Disclosure Publication DE 25 55 677 A1; its content is hereby incorporated by reference. Such hydraulic systems have proven themselves suitable in other applications in a paper or cardboard machine. Hydraulic fluid may also be used as lubricant for the gliding surfaces of support elements 16.

Winder 1 may include either two separate control units for reel drum 2—a first control unit for moving reel drum 2 and a second control unit for moving support elements 16, or a common control unit with superior intelligence for handling both functions.

Figure 2:
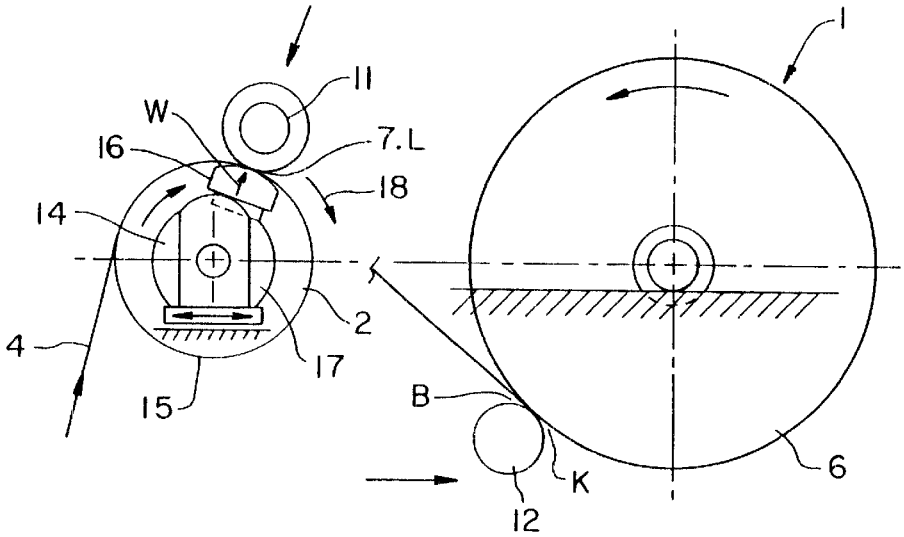
FIG. 2 is a schematic side view of the winder with a reel drum during the initial winding phase.

Now referring additionally to FIG. 2 there is shown a schematic side view of winder 1 including reel drum 2 during the initial winding phase. During this initial winding phase material web 4 is cut, by a device known in the art, preferably totally, however at least partially, and is transferred to empty reel spool 11 which contacts reel drum 2, creating winding nip 7. Wound roll 6 is removed from reel drum 2 prior to the start of the initial winding phase by means of the transport device, thereby opening nip 7 and creating a free web travel. It is to be noted that prior to the opening of winding nip 7 between reel drum 2 and wound roll 6, that air squeeze roll 12 contacts winding roll 6. Immediately upon creation of effective zone B between wound roll 6 and air loaded rider roll 12 active force K in effective zone B is controlled by movement of air loaded rider roll 12. A control circuit is one which is familiar to a person of ordinary skill and is for example disclosed in the previously mentioned applicant's German Disclosure Document DE 198 07 897 A1 (PR10678) for a reel drum; its content is hereby incorporated by reference. Air loaded rider roll 12 is moved to wound roll 6 while maintaining active force K in effective zone B. The relocation process is ended only when wound roll 6 has horizontally reached it's end position (reel spool change position).

Reel drum 2 is movable by means of contact pressure device 13, and reel drum 2 may be embodied as a deflection compensation roll 14, whose roll shell 15 is supported on stationary cross shaft 17 by means of a row of side by side support elements 16. Such an arrangement ensuring that the progression of line force L in winding nip 7 is adjustable, preferably controllable through relocation of reel drum 2 and/or at least one of support elements 16. Support elements 16 are effective in the direction of winding nip 7 whose position is changeable and cross shaft 17 can be pivoted so that effective direction W of support elements 16 follows the movement of winding nip 7, as indicated by arrow 18.

Figure 3:
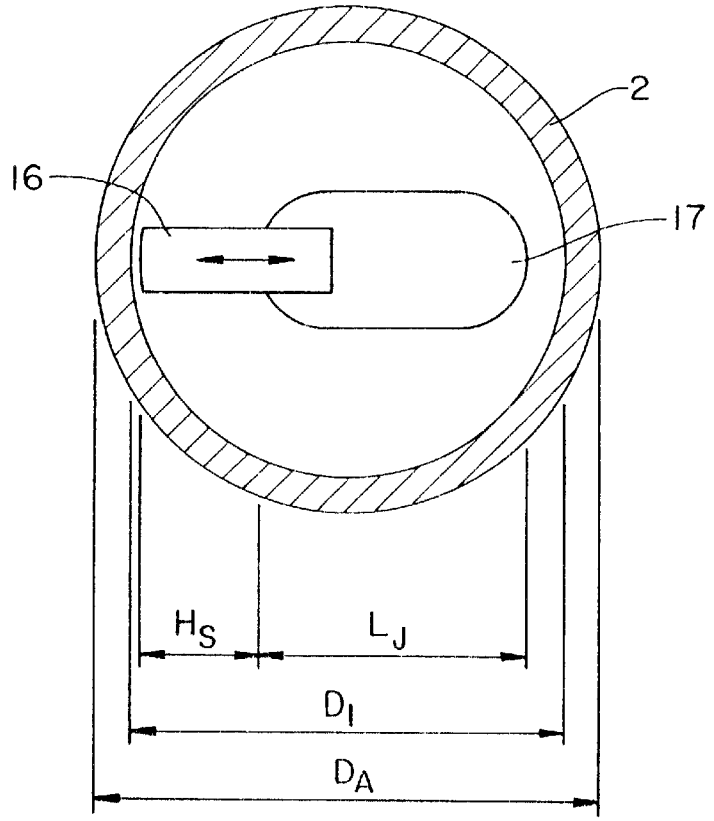
FIG. 3 is a sectional side view of the reel drum.
Figure 4:
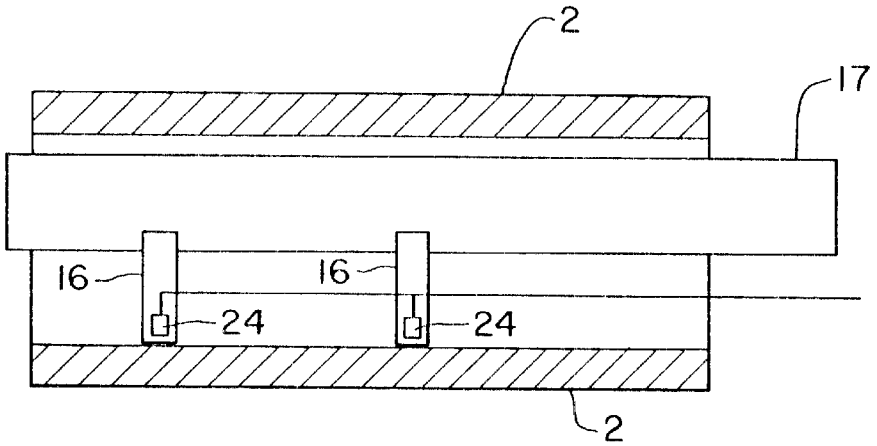
FIG. 4 is a sectional top view of the reel drum.

Now referring additionally to FIG. 3 there is shown a schematic side view of reel drum 2, with a row of support elements 16, arranged side by side and cross shaft 17. Support elements 16 have a support stroke $H_S$ of 150 to 400 mm, preferably of 200 to 300 mm. Cross shaft 17 has a shaft length $L_J$ of 500 to 800 mm, preferably 600 to 750 mm. Reel drum 2 has an inside diameter $D_I$ of 1,000 to 1,250 mm, preferably 1,100 to 1,200 mm and it has an outer diameter $D_A$ of 1,300 to 1,500 mm, preferably 1,350 to 1,450 mm. Support elements 16 have a support width $B_S$ of 25 to 500 mm, preferably of 50 to 250 mm.

While this invention has been described as having a preferred embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for the continuous winding of a material web onto a reel spool to create a wound roll, comprising the steps of:

guiding the material web over a shell surface of a reel drum;

establishing a winding nip at a line of contact between said reel drum and the wound roll;

winding the wound roll;

detecting at least one of long-wave diameter variations and short-wave diameter variations; and adjusting a line force along said line of contact at said winding nip, said adjusting step being dependent upon variations detected in said detecting step.

2. The method of claim 1, further comprising the step of controlling said line force in a zone-wise manner across said reel drum.

3. The method of claim 2, wherein said detecting step includes detecting long-wave diameter variations in the wound roll using a long-wave detector, said controlling step including the relocation of said reel drum to compensate for said long-wave diameter variations.

4. The method of claim 2, wherein said detecting step includes detecting short-wave diameter variations in the wound roll using a short-wave detector, wherein said reel drum includes at least one support element, said controlling step utilizing said at least one support element to compensate for said short-wave diameter variations.

5. The method of claim 4, wherein said reel drum is a deflection compensation roller.

6. A winder for the continuous winding of a material web onto a reel spool to create a wound roll, comprising:

a plurality of support elements positioned in a side-by-side manner relative to each other;

a cross shaft to which said support elements are attached;

a reel drum defining a winding nip with the wound roll, said reel drum comprising a deflection compensation roll including a roll shell being internally supported by said support elements, said support elements configured to adjust a line of force along said winding nip;

at least one of a long-wave detector associated with the wound roll and a short-wave detector associated with said reel drum; and a contact pressure device coupled with said reel drum for moving said reel drum.

7. The winder of claim 6, wherein said support elements are effective toward said winding nip.

8. The winder of claim 6, wherein said cross shaft is pivotable such that said support elements track a movement of said winding nip.

9. The winder of claim 6, wherein said support elements are configured as one of adjustable and controllable, in at least one of in their entirety, in sections, in groups and individually.

10. The winder of claim 9, further comprising:

a hydraulic system configured to actuate said support elements; and a control system configured to control said hydraulic system.

11. A winder for the continuous winding of a material web onto a reel spool to create a wound roll, comprising:

a plurality of support elements positioned in a side-by-side manner relative to each other;

a cross shaft to which said support elements are attached;

a reel drum defining a winding nip with the wound roll, said reel drum comprising a deflection compensation roll including a roll shell being internally supported by said support elements, said support elements have a support width said support width being between approximately 25 and 500 mm, said support elements configured to adjust a line of force along said winding nip;

at least one of a long-wave detector associated with the wound roll and a short-wave detector associated with said reel drum; and a contact pressure device coupled with said reel drum for moving said reel drum.

12. The winder of claim 11, wherein said support width is between approximately 50 and 250 mm.

13. A winder for the continuous winding of a material web onto a reel spool to create a wound roll, comprising:

a plurality of support elements positioned in a side-by-side manner relative to each other;

a cross shaft to which said support elements are attached;

a reel drum defining a winding nip with the wound roll, said reel drum comprising a deflection compensation roll including a roll shell being internally supported by said support elements, said support elements have a support stroke, said support stroke being between approximately 150 and 400 mm, said support elements configured to adjust a line of force along said winding nip;

at least one of a long-wave detector associated with the wound roll and a short-wave detector associated with said reel drum; and a contact pressure device coupled with said reel drum for moving said reel drum.

14. The winder of claim 13, wherein said support stroke is between approximately 200 and 300 mm.

15. A winder for the continuous winding of a material web onto a reel spool to create a wound roll, comprising:

a plurality of support elements positioned in a side-by-side manner relative to each other;

a cross shaft to which said support elements are attached, said cross shaft has a length, said length being between approximately 500 and 800 mm;

a reel drum defining a winding nip with the wound roll, said reel drum comprising a deflection compensation roll including a roll shell being internally supported by said support elements, said support elements configured to adjust a line of force along said winding nip;

at least one of a long-wave detector associated with the wound roll and a short-wave detector associated with said reel drum; and a contact pressure device coupled with said reel drum for moving said reel drum.

16. The winder of claim 15, wherein said length is between approximately 600 and 750 mm.

17. A winder for the continuous winding of a material web onto a reel spool to create a wound roll, comprising:

a plurality of support elements positioned in a side-by-side manner relative to each other;

a cross shaft to which said support elements are attached;

a reel drum defining a winding nip with the wound roll, said reel drum comprising a deflection compensation roll including a roll shell being internally supported by said support elements, said reel drum having an inside diameter of between approximately 1,000 and 1,250 mm, said support elements configured to adjust a line of force along said winding nip;

at least one of a long-wave detector associated with the wound roll and a short-wave detector associated with said reel drum; and a contact pressure device coupled with said reel drum for moving said reel drum.

18. The winder of claim 17, wherein said inside diameter is between approximately 1,100 and 1,200 mm.

19. A winder for the continuous winding of a material web onto a reel spool to create a wound roll, comprising:

a plurality of support elements positioned in a side-by-side manner relative to each other;

a cross shaft to which said support elements are attached;

a reel drum defining a winding nip with the wound roll, said reel drum comprising a deflection compensation roll including a roll shell being internally supported by said support elements, said reel drum having an outside diameter of between approximately 1,300 and 1,500 mm, said support elements configured to adjust a line of force along said winding nip:

at least one of a long-wave detector associated with the wound roll and a short-wave detector associated with said reel drum; and a contact pressure device coupled with said reel drum for moving said reel drum.

20. The winder of claim 19, wherein said outside diameter is between approximately 1,350 and 1,450 mm.

* * * * *

UNITED STATES PATENT AND TRADEMARK OFFICE

CERTIFICATE OF CORRECTION

PATENT NO. : 6,604,703 B2
DATED : August 12, 2003
INVENTOR(S) : Beisswanger et al.

It is certified that error appears in the above-identified patent and that said Letters Patent is hereby corrected as shown below:

Title page,
Item [56], References Cited, U.S PATENT DOCUMENTS, for Patent No. 6,129,305, delete "möet al", and substitute therefore -- Möller --.

Signed and Sealed this

Thirteenth Day of July, 2004

JON W. DUDAS
*Acting Director of the United States Patent and Trademark Office*